United States Patent [19]

del Castillo

[11] 3,945,292

[45] Mar. 23, 1976

[54] OPTICAL METRONOME

[76] Inventor: Juan M. del Castillo, Risco No. 119, Mexico City, 20, Mexico

[22] Filed: Mar. 13, 1975

[21] Appl. No.: 557,955

[52] U.S. Cl. ..... 84/484

[51] Int. Cl.[2] ..... G04F 5/02; G10G 1/00

[58] Field of Search ..... 84/484

[56] References Cited

UNITED STATES PATENTS

| | | | |
|---|---|---|---|
| 1,837,944 | 12/1931 | Blum | 84/484 |
| 2,915,121 | 12/1959 | Bloom | 84/484 |
| 3,743,758 | 7/1973 | del Castello | 84/484 |
| 3,803,971 | 4/1974 | Del Castillo | 84/484 |

*Primary Examiner*—Lawrence R. Franklin
*Attorney, Agent, or Firm*—Karl W. Flocks

[57] ABSTRACT

An optical metronome with a transparent continuous belt carrying vertical markings carried between rollers, supported between rigid transparent plates, and passing behind a translucent sheet of music through which the vertical markings are viewed. The lighting behind the belt is from horizontally extending tube type lamps and reflectors, or flat faced neon lamps which form one of said rigid transparent supporting plates with their flat faces.

4 Claims, 4 Drawing Figures

OPTICAL METRONOME

BACKGROUND OF THE INVENTION

The present invention relates to a device for aiding the teaching of the time or duration in the study of music. Such time or duration is generally determined by a metronome.

Optical metronomes have been used to point out the notes to the student at the time and for the duration that they are to be played. But in many cases these devices have not acclimated the student to the music sheet as he will observe and play it after he no longer requires such a teaching device.

SUMMARY OF THE INVENTION

It is an object of the present invention to provide a teaching device which will impart timing and rhythm to the student in the study of music by indicating the timing when each note is to be played.

It is also an object of the present invention to allow the student to view the whole music sheet without impediment to the view of any of the notes thereon, with the same view that he will have after he no longer has need for the present device.

It is a further object of the present invention to allow lighting of the sheet of music so as to obtain better diffraction effects and concentrate the lighting for clarity along the lines of music and also concentrate the student's attention on these lines of music.

It is a still further object of the present invention to provide support for a transparent belt carrying time markings thereon to prevent distracting oscillations in the belt and in those moving line markers.

Another object of the present invention is to provide such support by flat faced horizontally extending lamps with the duo purpose of lighting and support.

And another object is to provide the timing indication without any travelling marks in front of the sheet being viewed thus eliminating such distractions.

Basically the device of the present invention uses a transparent continuous belt with vertical markings carried between rollers, supported between rigid transparent plates or by the face of a lamp extending horizontally, and passing behind a translucent sheet of music through which the vertical markings are viewed.

BRIEF DESCRIPTION OF THE DRAWINGS

The above, as well as further objects and advantages which are inherent in the invention, will become apparent from the following description, reference being had to the accompanying drawings wherein.

DESCRIPTION OF THE PREFERRED EMBODIMENTS

Figure 1:
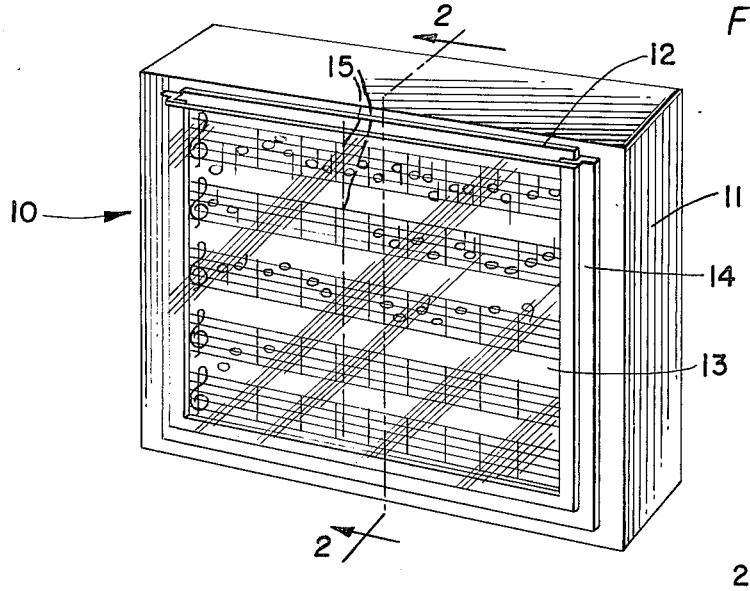
FIG. 1 is a perspective view of the optical metronome of the present invention as it appears in its case and in use.

Referring first to FIG. 1 there is shown therein the optical metronome 10 in case 11 with a sheet of music

12 supported on case 11 by a glass or clear plastic cover plate 13 in an open top frame 14. Also shown in FIG. 1 are vertical lines 15 which are seen through the translucent sheet 12 which may be of paper but not of such heavy weight and thickness as to obliterate such vertical lines. Vertical lines 15 are each at least the width of the range of musical notations and may be broken to the width of each single or grand staff on music sheet 12. Additional sets or at least another set (not shown) may be used.

Figure 2:
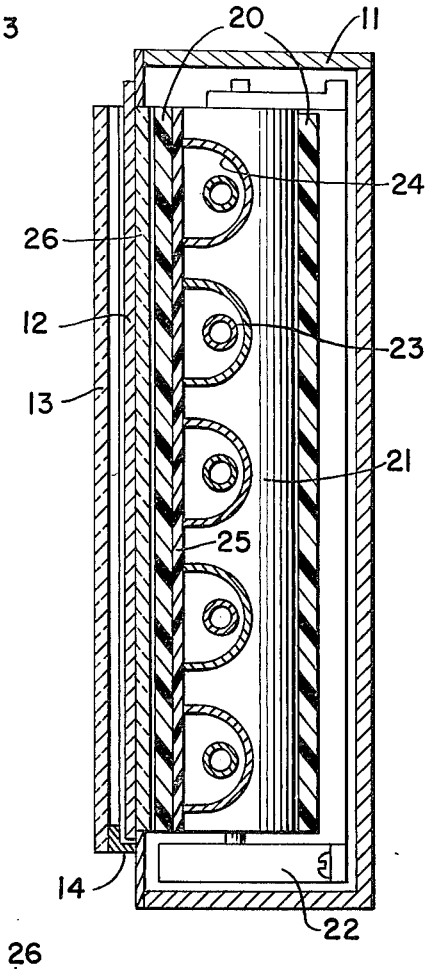
FIG. 2 is an enlarged side elevational sectioned view along lines 2—2 of FIG. 1.
Figure 3:
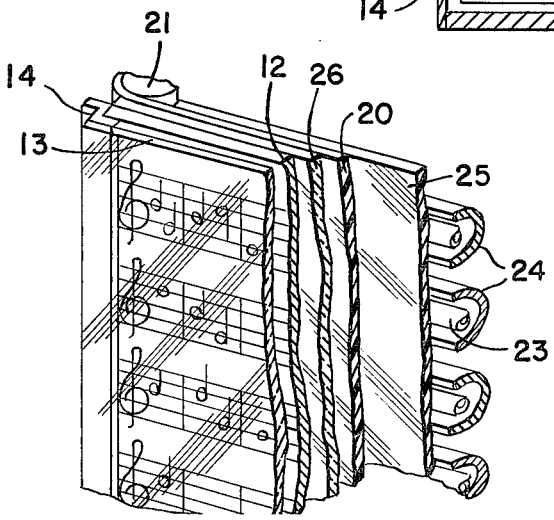
FIG. 3 is a partial perspective view of a portion of the device of FIGS. 1 and 2 but without its case for additional clarity.

Vertical lines 15 are drawn on transparent belt 20 which may be of a clear plastic and is shown in the side elevational view shown in section in FIG. 2. Referring also to FIG. 3 for clarity it is shown that transparent belt 20 is a continuous belt stretched between two rollers (only one of which is shown) wherein one roller 21 is driven by a motor shown in its motor case 22 in timed relationship to the spacing between the notes on music sheet 12. Mounted between the rollers are horizontal tube type lighting means 23 backed by reflectors 24. Between the portion of transparent belt 20 passing by the front of case 11 and reflectors 24 with horizontal tube type lighting means 23 is a glass or plastic transparent support 25 presenting a flat support surface to transparent belt 20 allowing the light to shine therethrough with diffraction characteristics of the horizontal lighting such as to allow easy observation and following of vertical lines 15 on belt 20 through music sheet 12.

Music sheet 12 is supported in frame 14, and easily removable therefrom, between cover plate 13 and glass or plastic transparent window 26 closing the front of case 11. The inside of transparent window 26 facing transparent belt 20 presents a firm support surface to belt 20 so that belt 20 has its front portion supported against oscillation between opposing surfaces of window 26 and transparent support 25.

Figure 4:
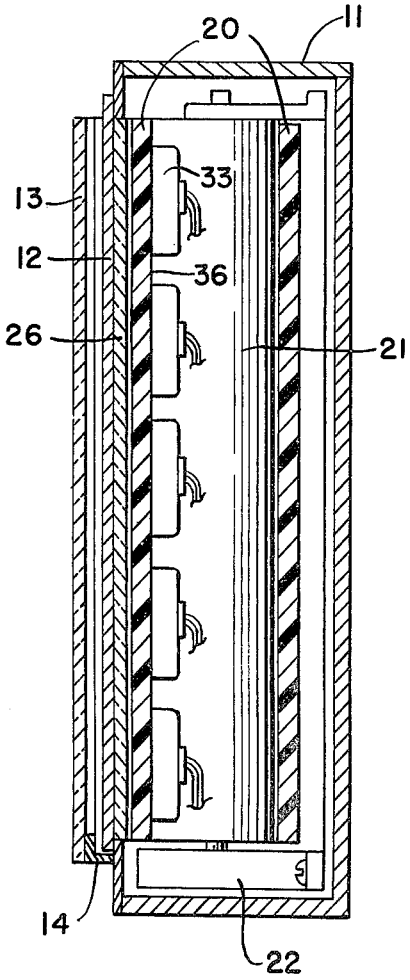
FIG. 4 is a second embodiment of the device of FIG. 1 shown in an enlarged side elevational sectioned view as taken along lines 2—2 of FIG. 1.

In the embodiment of FIG. 4 all parts similar to the first embodiment are numbered as in FIGS. 1–3. The device as shown in FIG. 4 eliminates the use of transparent support 25 and in its stead uses a long lamp 33 such as a neon gas tube light shaped to have a flat face 36 and with all of the remaining mechanism as previously described in the first embodiment. The long lamps 33 with flat faces 36 present flat surfaces to the portion of belt 20 for support of belt 20 between faces 36 and transparent window 26 and with their horizontal lighting also produce the diffraction characteristics of the horizontal tube type lighting means 23.

It will be obvious to those skilled in the art that various changes may be made without departing from the scope of the invention and the invention is not to be considered limited to what is shown in the drawings and described in the specification.

What is claimed is:

1. An optical metronome for use with a sheet of music having lines of notes thereon and having at least translucent light characteristics for the passing of light therethrough comprising a belt allowing light to pass therethrough and having vertical lines thereon extending transversely of said belt, rollers of which at least one is driven having said belt mounted thereon, horizontal lighting means mounted between said rollers and behind said belt, flat holding means for the sheet of music to hold the sheet of music in front of said belt, said horizontal lighting means including a plurality of elongated horizontally extending lamps with each of said lamps substantially centered behind one of the lines of notes on said sheet of music.

2. The optical metronome of claim 1, further characterized by support means allowing light to pass therethrough mounted between said horizontal lighting means and said sheet music holding means, said sheet music holding means including a window backing the sheet of music and presenting a surface for support of said belt between said surface and said support means.

3. The optical metronome of claim 1, further characterized by said horizontally extending lamps each having a front flat face surface presenting a surface for support backing said belt.

4. The optical metronome of claim 3, further characterized by said sheet holding means including a window backing the sheet of music and presenting a surface for support of said belt between said surface of said window and said front flat face surfaces of said horizontally extending lamps.

* * * * *